US005558769A

United States Patent [19]

Witthaus et al.

[11] Patent Number: 5,558,769

[45] Date of Patent: Sep. 24, 1996

[54] LATCHING APPARATUS FOR A BEARING ASSEMBLY PARTICULARLY FOR A CENTRIFUGE SEPARATION CHAMBER

[75] Inventors: Friedrich Witthaus, St. Wendel; Wolfram Weber, Spiesen-Elversberg; Lothar Leick, Merzig, all of Germany

[73] Assignee: Fresenius AG, Bad Homburg V.D.H., Germany

[21] Appl. No.: 303,300

[22] Filed: Sep. 8, 1994

[30] Foreign Application Priority Data

Sep. 11, 1993 [DE] Germany ..... 43 30 905.4

[51] Int. Cl.[6] ..... B04B 5/00

[52] U.S. Cl. ..... 210/360.1; 210/380.1; 494/84; 475/11; 475/107; 475/182

[58] Field of Search ..... 210/360.1, 380.1, 210/512.1; 494/18, 84; 475/11, 107, 182

[56] References Cited

U.S. PATENT DOCUMENTS

| | | | |
|---|---|---|---|
| 3,986,442 | 10/1976 | Khoja et al. . | |
| 4,261,507 | 3/1981 | Baumler | 494/84 |
| 4,540,397 | 9/1985 | Lolachi et al. | 494/84 |
| 5,350,514 | 9/1994 | Witthaus et al. | 210/360.1 |

FOREIGN PATENT DOCUMENTS

| | | |
|---|---|---|
| 3242541 | 9/1987 | Germany . |
| 4220232 | 12/1993 | Germany . |
| 56-076260 | 6/1981 | Japan . |

*Primary Examiner*—David A. Reifsnyder
*Attorney, Agent, or Firm*—Panitch, Schwarze, Jacobs & Nadel, P.C.

[57] ABSTRACT

A latching apparatus is provided for a bearing assembly in which at least three bearing rollers, each of which is supported in a rotating fashion on a bearing journal, are arranged rotationally symmetrical and lying in one plane and guide and support a bearing race between them. The bearing journals are arranged on a carrier device that is in turn supported in a rotating fashion on a central axle aligned with the axis of rotation of the bearing race, so that the bearing race and the carrier device can rotate at different RPMs. Such a bearing assembly on a rotating carrier is especially well-suited for a centrifuge, in which a separation chamber with a centrally secured line is to be driven in such a way that the tube does not become twisted. The latching apparatus has bearing journals (22) arranged eccentrically on pins (74) rotatably supported in the carrier device (36) and a gear system component (84, 86) that rotates or revolves at the same angular velocity as the carrier device (36) and engages the pins (74) in such a way that when the gear system component is turned, the pins engaged with the gear system component are turned at the same time relative to the carrier device. The gear system component (84) is coupled by means of at least one coupling link (94; 122, 124, 142) with a shaft (40; 140) supported within a housing. Means are provided for imparting to the gear system component (84, 86) a relative movement with respect to the carrier device.

25 Claims, 3 Drawing Sheets

LATCHING APPARATUS FOR A BEARING ASSEMBLY PARTICULARLY FOR A CENTRIFUGE SEPARATION CHAMBER

FIELD OF THE INVENTION

The invention relates to a latching apparatus for a known bearing assembly of a centrifuge.

BACKGROUND OF THE INVENTION

The known bearing assembly comprises at least three bearing rollers, each of which is rotatably supported on a bearing journal, and which are arranged rotationally symmetrical and lying in one plane, and which guide and support a bearing race between them. The bearing journals are arranged on a carrier device that is in turn rotatably supported on a central axle aligned with the axis of rotation of the bearing race. The bearing race is driven by a drive apparatus in such a fashion that the carrier device and the bearing race rotate with different angular velocities relative to a stationary housing.

The centrifuge has a disposable separation chamber with a bearing race and a line attached in a fixed manner. The chamber is supported between the bearing rollers, whereby a free floating tube segment or line section is carried around by means of a keeper at half the angular velocity of the rotating separation chamber, so that any twisting around its longitudinal axis is prevented. In the centrifuge art the carrier device is also known as a rotor.

A centrifuge with a conventional bearing assembly for supporting the separation chamber is described, for example, in German patent application 42 20 232.9, assigned to the same assignee as the present invention. A similar bearing assembly is known from JP 56/76260A. In the latter bearing assembly, a hollow, cylindrical axle segment is guided between a total of six bearing rollers arranged one above the other in two planes, whereby in each plane three bearing rollers in the form of ball bearings are arranged in a rotationally symmetrical fashion. In connection with this, a separation chamber is arranged on the top end of the essentially vertical hollow axle segment, and a discharge line is connected to its bottom end. In this regard, a free floating segment of the line is guided within the rotor and runs at half the RPMs compared to the RPMs of the separation chamber, in order to prevent any twisting together of the tube segment or of the entire discharge line. The basic principle of guiding the free floating tube segment around a rotating separation chamber at half angular velocity is known from German Patent 32 42 541, also assigned to the same assignee as the present invention.

In the case of the known centrifuge from the Japanese reference, have a conventional bearing assembly, two bearings are provided arranged one above the other and are displacable in a radial direction, in order to thus make possible the removal of the axle segment and the separation chamber and discharge line connected to it. In the case of a bearing assembly, likewise known from the Japanese reference, in which a total of eight bearings are arranged in two planes, four bearings are arranged rotationally symmetrical to one another in each plane. At a total of two bearing locations, that is two sets of bearings arranged one above the other, the bearings are displacable in a radial direction in order to create an opening through which the axle segment, and with it the separation chamber and the discharge line, can be removed in a radial direction.

The bearing assembly known in the art is thus very difficult to handle during an exchange of the guided bearing race or axle segment or a separation chamber joined with it, which is particularly problematic when the bearing assembly is part of a centrifuge used in a hospital. Centrifuges with a conventional bearing assembly of this type are used in particular for the separation of cells in internal body fluids, such as blood in particular, whereby the separation chamber and the line fixedly connected to it are often configured as a disposable part made of plastic. In day-to-day hospital operations a number of centrifuge procedures for cell separation are carried out on one centrifuge, whereby each time—for reasons of incompatibility—the disposable separation chamber has to be exchanged. When such use is made of a centrifuge with a conventional bearing assembly, the bearing assembly known from the art leads to a significant loss of time.

SUMMARY OF THE INVENTION

The invention is therefore based on the object of creating for a conventional bearing assembly a latching apparatus that makes possible quick removal of the bearing race, and in particular a separation chamber joined with it, as well as quick insertion, and that is simple to use and robust.

The solution of this object is achieved in the case of a conventional bearing assembly by means of a latching apparatus in which the bearing journals are arranged eccentrically on pins rotatably supported in and relative to the carrier device, in conjunction with which a gear system component that rotates or revolves at the same angular velocity as the carrier device engages with the pins in such a way that when the gear system component is turned, the pins engaged with the gear system component are turned at the same time relative to the carrier device. The gear system component is coupled by means of at least one coupling link with a shaft supported within the housing, and means are provided for imparting to the gear system component a relative movement with reference to the carrier device.

In this connection, the invention is directed in particular towards a bearing assembly in which only three bearing rollers are arranged in a rotationally symmetrical fashion in one plane. However, it is also easily conceivable to use the invention for a bearing assembly in which at least six bearing rollers are placed one above the other in two planes, as this is known in the art.

In a preferred embodiment of the invention, the gear system component engaged with the pins that support the bearing journals of the bearing rollers have a hollow shaft arranged coaxially with the rotation axis of the carrier apparatus or rotor, and with the axis of rotation of the bearing race. By means of such an arrangement it is possible to attain an especially compact configuration of a latching apparatus in accordance with the invention, which is particularly important if a centrifuge is to be designed in a compact way such that it can be used as a desk-top unit for hospital procedures. It is preferable, in this regard, if provision is made so that the hollow shaft is joined at its upper end with a gearwheel that engages with respective gearwheels arranged on the perimeter of each pin. In conjunction with this, the gearwheels arranged on the perimeter of the bolts can be made as segments, so that gear teeth are provided only in the area in which they are actually needed. By means of the described configuration of a latching mechanism in accordance with the invention, in which gear teeth are used to couple the gear system component with the pins, an especially robust configuration is achieved that is particularly well-suited for continuous operation in a hospital.

Furthermore, in order to further develop a compact configuration of the entire bearing assembly or centrifuge, provision is made that the hollow shaft is supported by means of rolling bearings in a bearing flange that rotates with the rotor. In addition, a gear system shaft for driving the bearing race is supported by means of rolling bearings in the hollow shaft, and the rotor is supported in the housing by means of rolling bearings. In this manner, a, so to speak, concentric layout of the entire assembly is achieved that makes possible a space-saving arrangement of all rolling bearings and contributes to making the entire apparatus compact.

As a further advantage, provision is also made that a motor arranged on the housing is provided with an output shaft on which are placed two pulleys, the first of which drives the rotor by means of a traction mechanism, in particular in the form of a drive belt, and a second drive pulley which drives the hollow shaft at the same RPM by means of a second traction mechanism, again in the form of a drive 10 belt. Such an embodiment offers the advantage that the means for imparting to the gear system component, which is engaged with the pins and which is to bring about a swiveling of the bearing rollers, a relative movement with reference to the carrier device or the rotor, can be configured in a simple way, and in particular by guiding the second traction mechanism, configured in the form of a drive belt, on sprocket wheels.

In this regard, the return free-running section as well as the driving free-running section of the drive belt can be guided by one sprocket wheel each, whereby the axles of the sprocket wheels can be displaced in a direction tranverse to the direction of movement of the drive belt. For this purpose, it is preferable if the axles of both sprocket wheels are arranged on a common, movable carriage which, in addition, can be connected with actuation means, for example, in the form of a linear motor, that can be controlled electrically.

It is also preferable if provision is made that the angle of belt wrap around a sprocket wheel amounts to 180° for each of the free-running sections. In this connection, it is advantageous if an arrangement of the drive belt takes the form that the outside of the drive belt is guided on both sprocket wheels, while the inside faces the driving pulley. It is further advantageous to provide two additional bearing rollers in the form of tensioning rollers that make possible an angle of belt wrap of 180° around the sprocket wheels, as well as to hold the belt tension at a tension sufficient for functioning of the apparatus.

Because of the described arrangement, a means is created, in a simple and highly practical way, of imparting to the co-rotating gear system component a relative movement with respect to the rotor. This results in the pins being turned and the eccentrically arranged bearing journals swivelling radially outward along with all of the bearing rollers, so that the bearing race, and along with it the separation chamber, can be removed upwards in an axial direction.

As an alternative to the described embodiment of the means for bringing about the relative movement, an arrangement can be selected in which the hollow shaft is driven by means of an epicyclic gear system, specifically a planetary gear system, whereby provision can be made, in particular, that the hollow shaft is surrounded by a planetary gear system ring gear supported on a rolling bearing mounted on the outside of the hollow shaft. At one end of the hollow shaft can be arranged a flange that functions as a planetary gear carrier and that carries planetary gears that are driven by a sun gear arranged on the central gear system shaft, whereby the transmission of the entire planetary gear system is selected in such a way that the hollow shaft rotates at the same RPMs as the rotor or the carrier device for the bearing journals of the bearing rollers that hold the bearing race. When the ring gear is standing still, normal operation of the centrifuge is thus possible. In order to open the bearing assembly, that is in order to bring about a relative movement between the hollow shaft or gear system component linked to it and the rotor (the carrier device), the ring gear can be turned, for example, by way of a mounted drive belt or, preferably, by means of external gear teeth engaged by a gearwheel of a servomotor.

In this way as well, it is possible to achieve an extremely compact design for the latching mechanism in accordance with the invention, so that the entire bearing assembly with the latching mechanism in accordance with the invention can also be used for desk-top units.

Both embodiments of the invention are especially well-suited for an arrangement of bearing rollers that lie in only one plane, although an arrangement of bearing rollers in more than one plane, and in particular in two planes, is easily possible. In the case of an arrangement of bearing rollers in only one plane, provision is made in particular that the bearing rollers have running surfaces that are either concave or convex in cross-section, and the bearing race has a running surface that has a complementary convex or concave cross-section. Thus, when the bearing rollers are brought together, that is when the latching mechanism is closed, a form closure on the separation chamber and the bearing race is created in the axial direction, so that the bearing race and the part connected with it, in particular a separation chamber, are guided in a secure manner.

By configuring the latching mechanism in accordance with the invention, it is possible to provide stationary, that is non-rotating, operating elements that are arranged, for example, or the housing of a centrifuge, so that the handling of the latching mechanism is very simple. In addition, electrical actuation of the latching mechanism is easily possible without it being necessary to feed an electrical switching current via rotating contacts, for example, in the form of slip rings. Furthermore, the latching in accordance with the invention can be carried out in every position of the rotor (the carrier device).

In principle, the invention is suitable for all bearing assemblies that rotate as a whole and in which a movement with respect to a stationary housing is to be guided in a rotating system, for example a rotor.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figures 1, 1A:
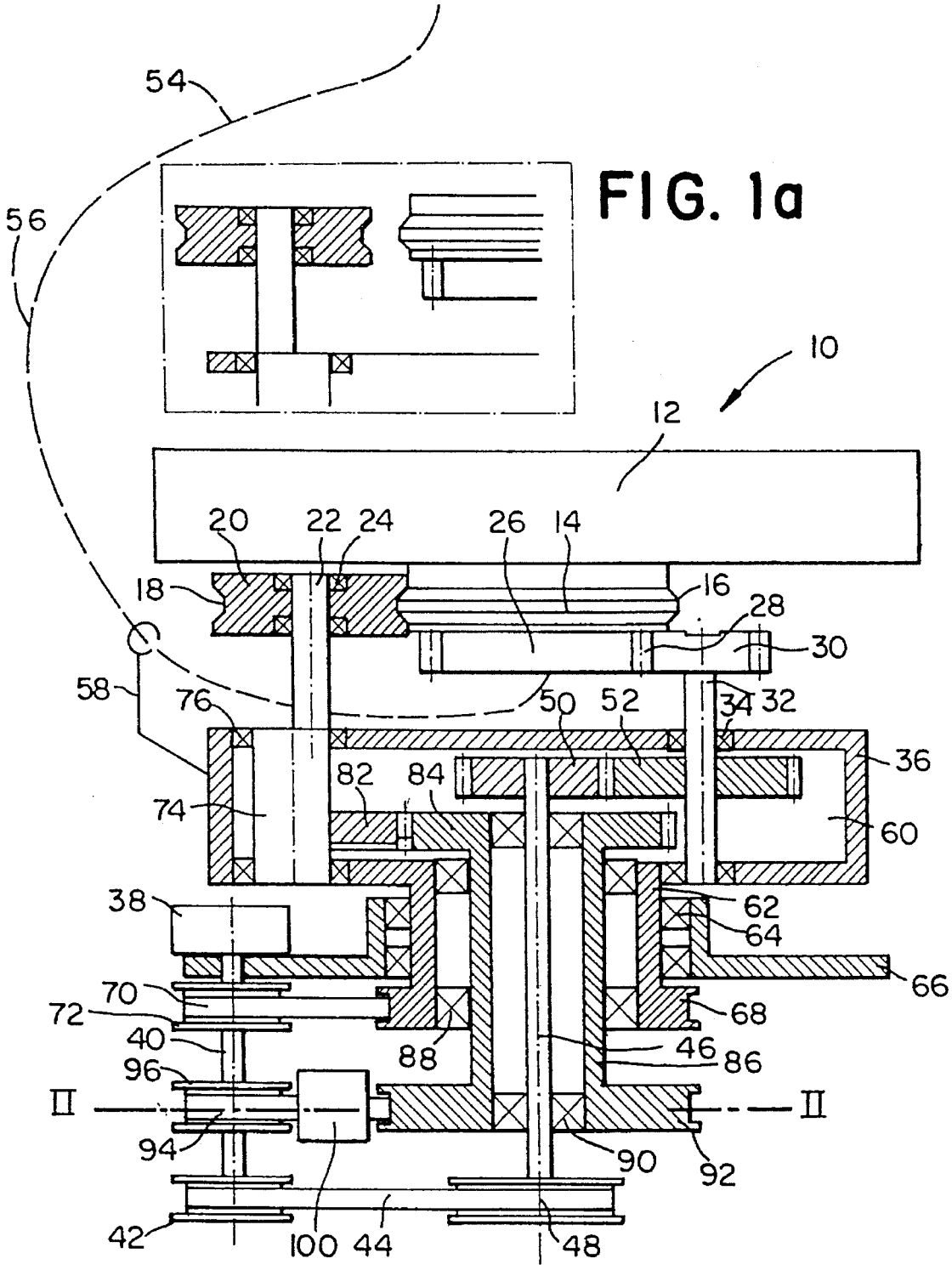
FIG. 1 is a cross-section through a centrifuge with a mounted separation chamber and a latching mechanism for a bearing assembly in accordance with a first embodiment of the invention.
FIG. 1*a* is a partial schematic diagram showing a bearing roller from the bearing assembly of FIG. 1 in the disengaged position.
Figure 2:
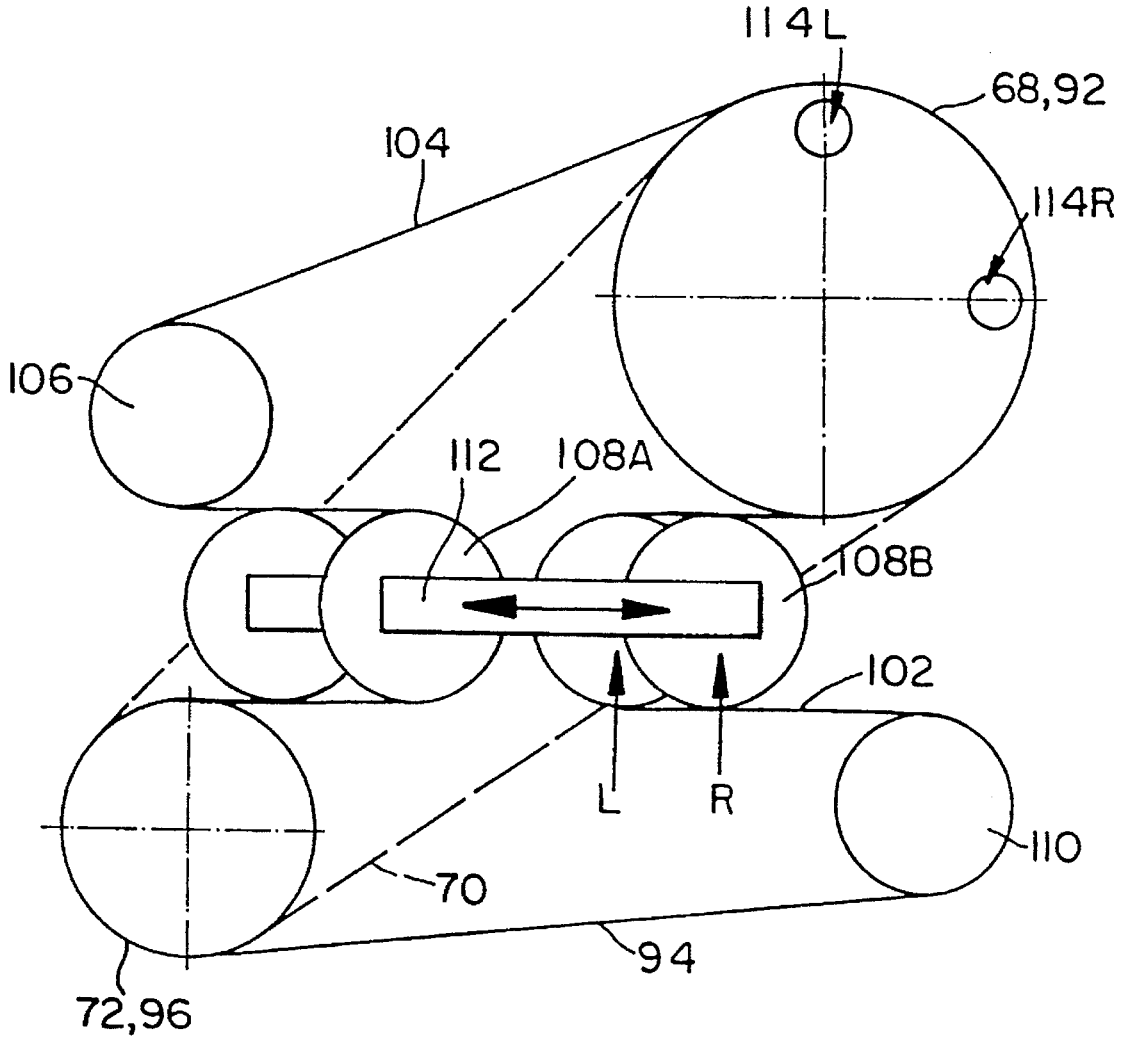
FIG. 2 is a schematic cross-section taken along line II—II in FIG. 1.
Figures 3, 3A:
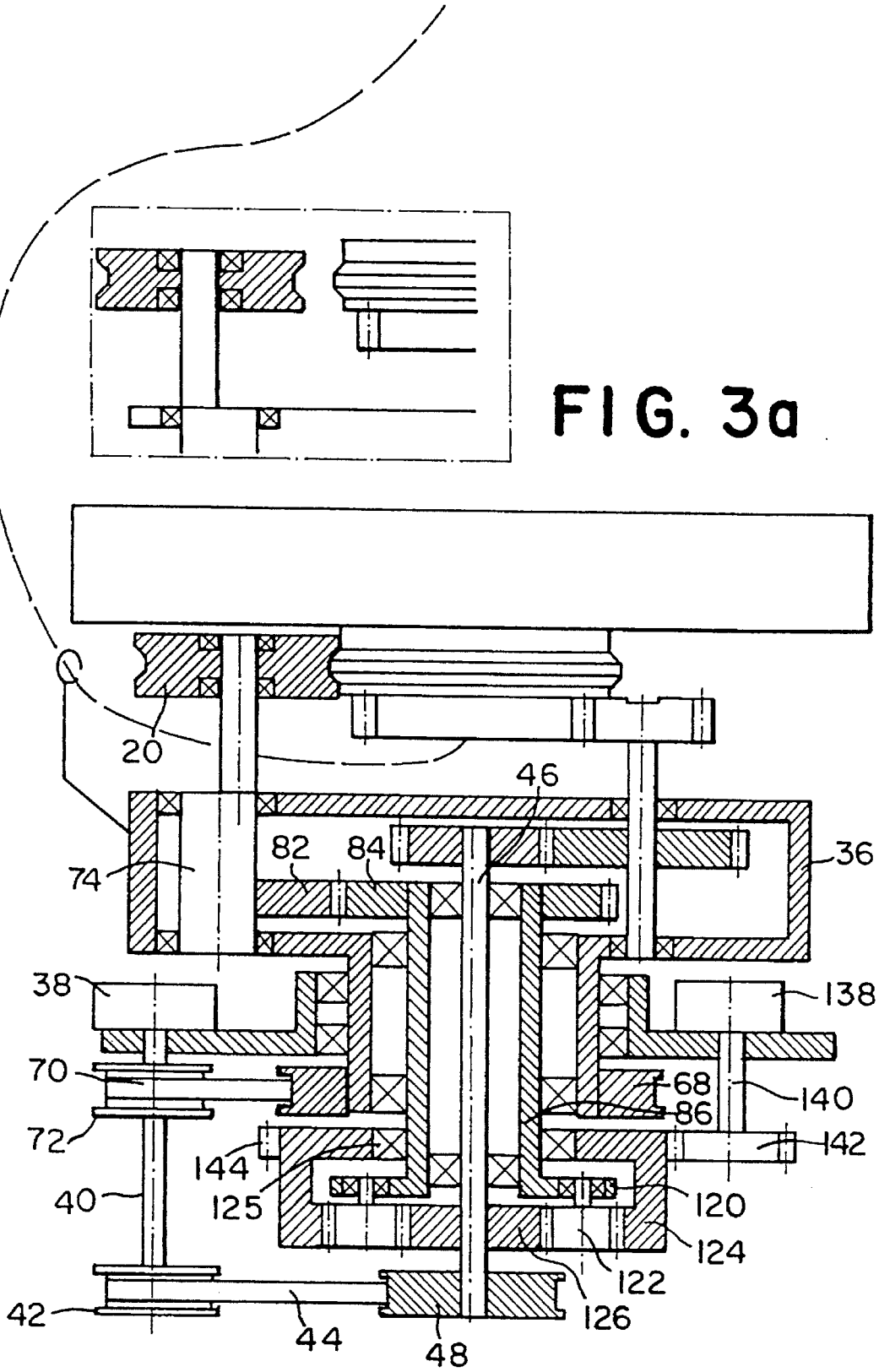
FIG. 3 is a cross-section through a centrifuge with a mounted separation chamber and a latching mechanism for a bearing assembly in accordance with a second embodiment of the invention.
FIG. 3*a* is a partial schematic diagram showing a bearing roller from the bearing assembly of FIG. 3 in the disengaged position.

In FIGS. 1 and 2, as well as in FIG. 3 which shows a second embodiment, parts that are identical or that have the same function have been designated with the same reference numerals.

A centrifuge 10 has a separation chamber 12 in which a fluid, for example blood, is to be separated into components of varying densities. The separation chamber 12 is configured in one piece with a bearing race 14, the running surface 16 of which is convex in cross-section. With the convex running surface 16, the bearing race 14 engages the corresponding complementary concave-shaped running surfaces 18 of three bearing rollers 20, of which only one can be seen in each of FIGS. 1 and 3 because of the way in which the section is drawn. The three bearing rollers 20 lie in a single plane and are rotationally symmetrical, that is, they are arranged with a zenith angle of 120°. Each bearing roller 20 is supported on a bearing journal 22 by means of two ball bearings 24.

Connected with the bearing race 14, the separation chamber 12 has a flange 26 with external gear teeth 28. A pinion gear 30 joined with a shaft 32 engages the external gear teeth 28. The shaft 32 is supported by two ball bearings 34 in a carrier device 36, which is also designated as a rotor. Shaft 32 is driven by means of a gear system from a motor 38 by a drive shaft 40. The drive shaft 40 has on its end opposite to the motor 38 a pulley 42, which in this context is designated as the third pulley. By means of a drive belt 44, the third pulley 42 drives a pulley 48 arranged on an end of a centrally located drive shaft 46, and thus drives the drive shaft itself. The drive shaft 46 carries on its other end a gearwheel 50 which produces, with an additional gearwheel 52 arranged on the shaft 32, a reduction in gear ratio.

Thus, by means of the drive shaft 40, the motor 38 drives the traction mechanism comprising pulley 42, drive belt 44 and pulley 48, as well as the drive shaft 46, the ratio reduction gear made up of the gearwheels 50 and 52, the shaft 32 and the pinion gear 30, the flange 26 that is provided with external gear teeth 28, and thereby rotates the separation chamber 12. As a result of the centrifugal forces that are created, heavier components of the blood are collected towards the outside, while lighter components can be drawn off by means of a tube 54 that is centrally joined with the separation chamber 12. In this regard, the separation chamber 12 is supported, by means of the bearing race 14, between the three bearing rollers 20, whose bearing journals 22 are supported on bearings in the carrier device 36 in the same way as the shaft 32.

The separation chamber 12 is configured in one piece with the bearing race 14 and the gearwheel flange 26, and is joined with the tube 54 in a fixed fashion. Both parts together are produced as a disposable part made of plastic.

In order to prevent any twisting of the tube 54 when the separation chamber 12 is rotating, it is necessary that the free floating tube segment 56 of the tube 54 be carried around at half of the angular velocity with which the separation chamber 12 rotates. For this reason, the tube 54 is linked by means of a keeper 58 to the carrier device 36, which is configured as a rotor and is driven at half of the angular velocity at which the separation chamber 12 rotates during operation. By this design, which is known per se, it becomes possible to fixedly join the tube 54 with the separation chamber 12 and to dispense with sliding seals, such as for example floating ring seals. In order to be able to remove the disposable part made up of the tube 54 and the separation chamber 12, the tube is guided between two bearing rollers 20.

The rotor 36 comprises a part 60 that is essentially shaped as a hollow cylinder and that continues down to a smaller diameter cylindrical flange 62. On the flange 62 are arranged two ball bearings 64, by means of which the rotor 36 is supported in a housing 66. The housing 66 does not turn and thus forms, for the following description, a fixed set of coordinates. The previously mentioned motor 38 is attached to the housing 66 by means of a flange.

The flange 62 of the rotor 36 continues into a pulley 68, which is driven by a belt 70. This belt 70 runs on a pulley 72 that is in turn arranged on the drive shaft 40 of the motor 38, and thus rotates with the same angular velocity as the pulley 42. In this context, the pulley 72 is designated as the first pulley.

The overall gear ratio of the above-described drive mechanism for the separation chamber 12 and the transmission from the drive shaft 40 to the rotor 36 are dimensioned in such a way that the aforementioned necessary doubled RPM relationship for the separation chamber 12 is achieved. The rotor 36 carries with it, by means of the keeper 58, the free floating tube segment 56 of the tube, whereby the tube 54 remains untwisted in spite of the rotation of the separation chamber 12.

The bearing journals 22 of the bearing rollers 20 are arranged eccentrically on pins 74, that are arranged in the carrier device or rotor 36 in a rotatable fashion by means of bearings 76. In order to be able to lift out the separation chamber 12 with the attached tube 54 upwards through the bearing assembly formed by the three bearing rollers, it is necessary, as a result of the profiling of the bearing race 14 and the complementary profiling 18 of the bearing rollers 20, that the bearing rollers be swiveled in an outward direction by rotation of the respective pins 74 as indicated by the partial schematic diagram of FIG. 1*a*.

In order to be able to carry out the simultaneous outward swiveling or rotating of the pins 74, a latching apparatus is provided. Each of the pins 74 is joined at its perimeter with a segment-like gearwheel 82. The toothed perimeter sections of the segment-like gearwheels 82 are engaged with a centrally arranged gearwheel 84, which is shrunk onto a hollow shaft 86 that runs coaxially with the drive shaft 46 and the axis of rotation of the rotor 36 and the separation chamber 12. The hollow shaft 86 is supported on the interior of the flange 62 of the rotor 36 by means of ball bearing 88. In turn, the interior of the hollow shaft 86 forms a bearing surface for the central drive shaft 46 for the separation chamber 12, which is supported by means of bearings 90.

At its lower end, the hollow shaft 86 makes a transition into a flange that is configured as a pulley 92. The pulley 92 carries at its perimeter a belt 94, which is driven by a pulley 96, which in the context of this description is designated as the second pulley. The gear ratio, that is the diameter relationship, between the pulley 68 of the rotor 36 and the first driving pulley 72 is exactly as great as that between the pulley 92 of the hollow shaft 86 and the second driving pulley 96, so that the rotor 36 and hollow shaft 86 rotate with the same angular velocity, when the motor 38 is switched on.

The gearwheel 84 engaged with the pins 74 by means of the gearwheel segments 82 can be defined in general terms as a gear system component. In normal operation, the gear system component 84 rotates at the same RPM or angular velocity as the rotor 36. In accordance with the invention, means are provided in order to create a relative movement between the gear system component 84 that is joined to the hollow shaft 86 and the rotor 36 (carrier device). These means are shown schematically in FIG. 1, designated by the reference numeral 100, and diagrammatically in FIG. 2. FIG. 2 shows a view of the cross-section along line II—II in FIG. 1 as seen from below.

In accordance with that, the first driving pulley 72 and the second driving pulley 96 in FIG. 2 lie one behind the other, and likewise the pulleys 68 and 92 lie one behind the other. Shown in dashed lines is the drive belt 70, which turns the pulley 68 of the rotor 36. The second drive belt 94, which runs over the second pulley 96 and the pulley 92 of the hollow shaft 86, consists of—assuming that the drive pulleys turn in a clockwise direction in FIG. 2—a delivery side, or in other words, a driving free-running section 102, and a non-driving, return free-running section 104. The entire belt 94 runs over a total of four bearing rollers 106, 108A, 108B and 110. In this regard, two sprocket wheels 108A and 108B are arranged on a movable carriage 112 in relation to two tensioning wheels 106 and 110 in such a way that the free-running section 104 is guided around the sprocket wheel 108A with a belt wrap angle of 180°, exactly the same as the free-running section 102 around the sprocket wheel 108B. In conjunction with this, the two belt-tensioning wheels 106 and 110 can be spring-loaded and can provide for the necessary belt tension.

As shown in FIG. 2, the carriage 112 can be moved between two positions, whereby when the motor is stopped, that is pulley 96 is stationary, movement of the carriage 112 towards the left in FIG. 2, results in shortening the free-running section 104 while the free-running section 102 is lengthened by an amount equivalent to a movement of the pulley 92 in the clockwise direction, whereby the mark 114 is rotated 90°. Thus, when both bearing rollers 108A and 108B are located along with the carriage 112, in the indicated position to the left in FIG. 2, then in that case, the mark 114 is in the right position of the two positions shown. In this way—even when the motor 38 is running—the hollow shaft 86 and, along with it, the gearwheel 84 can be turned with respect to the rotor 36, as a result of which the pins 74 are turned in such a way that the bearing journals 22 that are arranged on them, and along with the pins, the profiled bearing rollers 20 are swiveled to the outside. As a result, it becomes possible to lift out the separation chamber 12 upwards, whereby the tube 54 slides through between two bearing rollers 20.

The carriage 112 can be joined to an operating rod, not shown in FIG. 2, that can be operated either manually or by means of a linear motor. If a linear motor or some other kind of electronically controllable actuation means is used, an electronic control can be provided that permits movement of the carriage 112 and thus an opening of the latch only when the separation chamber 12 has come to a stop.

FIG. 3 shows an alternative embodiment of the invention in which the means for the relative turning of the gear system component or the gearwheel 84 with respect to the rotor 36 is configured in an alternative fashion. The rest of the construction of the centrifuge shown in FIG. 3 corresponds to the one shown in FIG. 1, so a repetition of the explanation of the same parts is not necessary. As shown in FIG. 3, there is no pulley 92 located at the lower end of the hollow shaft 86, but instead a flange 120 serves as a planetary gear carrier for planetary gears 122 of a planetary gear system. The planetary gears run on a ring gear 124 that is fixed during normal operation of the centrifuge, and are driven by a sun gear 126 connected to the central drive shaft 46. The ring gear 124 is supported on the perimeter of the hollow shaft by a rolling bearing 125.

In conjunction with this, the pulley 42 connected to the drive shaft 40 of motor 38 drives the drive belt 44 and the pulley 48 of the central drive shaft 46, as is the case with the embodiment shown in FIG. 1. The gear ratio of the epicyclic gear system (planetary gear system) comprising sun gear 126, planetary gears 122 and ring gear 124 is dimensioned in such a way that the RPM of the planetary gear carrier 120, and with it the hollow shaft 86, is exactly as great as the RPM of the rotor 36, which is driven by the pulley 72 by means of the pulley 68 and the drive belt 70. During normal operation of the centrifuge, there thus arises no difference in RPM between the rotor 36 and the hollow shaft 86.

If the bearing assembly is to be opened, a rotating movement is induced by means of a second servomotor 138, a drive shaft 140 and a gearwheel 142, via external gear teeth 144 on the ring gear 124, so that if the sun gear 126 is standing still, the planetary carrier 120 is turned. This results in a relative turning of the hollow shaft 86 with respect to the rotor 36, whereby the gear system component or gearwheel 84 turns the pins 74 by means of the gearwheel segments 82, and thus moves the bearing rollers 20 away from each other, as shown in the schematic diagram of FIG. 3*a*. As is the case with the first embodiment, provision can also be made in this embodiment to provide the servomotor 138 with an electronic control that prevents opening of the latch while the separation chamber 12 is being driven.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A latching apparatus for a bearing assembly for a removable part having a bearing race, comprising at least three bearing rollers each of which is rotatably supported on a respective bearing journal, said three bearing rollers, being positioned rotationally symmetrical and lying in one plane to guide and support between them the bearing race, the bearing journals being supported by a rotor that is in turn rotatably supported on a central axle aligned with a rotation axis of the bearing race, the bearing race and the removable part being driven by a drive apparatus such that the rotor and bearing race rotate with different angular velocities relative to a stationary housing, each of the bearing journals being located eccentrically on respective pins rotatably supported in the rotor, a gear system component that rotates at the same angular velocity as the rotor and engages said pins in such a way that when the gear system component is rotated, the pins engaged by the gear system component are rotated concurrently with the rotor, the gear system component being coupled by means of at least one coupling link with a shaft supported within the housing, and means for imparting to the gear system component a relative movement with respect to the rotor.

2. The latching apparatus in accordance with claim 1, wherein the gear system component comprises a hollow shaft positioned coaxially with the central axle of the rotor and with the rotation axis of the bearing race.

3. The latching apparatus in accordance with claim 2, wherein the hollow shaft is joined on an end with a first gearwheel, said first gearwheel engaging a plurality of gearwheels, each of said gearwheels being positioned at a perimeter of each pin.

4. The latching apparatus in accordance with claim 3, wherein the gearwheels comprise gear segments.

5. The latching apparatus in accordance with claim 2, wherein the hollow shaft is supported by means of second rolling bearings in a bearing flange that rotates with the rotor.

6. The latching apparatus in accordance with claim 2, further comprising a gear system shaft for driving the bearing race, said gear system shaft being supported by means of third rolling bearings in the hollow shaft.

7. The latching apparatus in accordance with claim 6, wherein the drive apparatus comprises a motor mounted on the housing and provided with an output shaft on which two drive pulleys are supported, the first of which drives the rotor by means of a first traction mechanism at a predetermined RPM, and the second of which drives the hollow shaft by means of a second traction mechanism at the same RPM.

8. The latching apparatus in accordance with claim 7, wherein the second traction mechanism comprises a drive belt having a return free-running section and a driving free-running section guided by one sprocket wheel each, the sprocket wheels having axles which are displaceable in a direction transverse to a direction of movement of the drive belt.

9. The latching apparatus in accordance with claim 8, wherein the drive belt has an inner side that faces the second drive pulley and an outer side that is guided on the two sprocket wheels.

10. The latching apparatus in accordance with claim 9, wherein the drive belt is guided with its inner side around two tensioning rollers.

11. The latching apparatus in accordance with claim 8, wherein an angle of belt wrap around a sprocket wheel amounts to 180 degrees for each of the free-running sections.

12. The latching apparatus in accordance with claim 8, wherein the two sprocket wheels are mounted on a common, movable carriage.

13. The latching apparatus in accordance with claim 12, wherein the carriage is joined with a means for moving the carriage between a first position and a second position to open the latching apparatus.

14. The latching apparatus in accordance with claim 13, wherein the means of operation is electrically actuatable.

15. The latching apparatus in accordance with claim 7, wherein the drive shaft has mounted thereon a third pulley, which drives the gear system shaft by means of a second traction mechanism.

16. The latching apparatus in accordance with claim 6, wherein the hollow shaft and the gear system shaft are coupled to one another by means of a planetary gear system.

17. The latching apparatus in accordance with claim 16, wherein the drive apparatus comprises a motor mounted on the housing with an output shaft on which two drive pulleys are supported, the first of which drives the rotor by means of a first traction mechanism, and the second of which drives the gear system shaft by means of a second traction mechanism.

18. The latching apparatus in accordance with claim 16, wherein a sun gear of the planetary gear system is located on the gear system shaft the hollow shaft has a planetary gear carrier configured as a flange, and a ring gear is supported on a perimeter of the hollow shaft by means of a rolling bearing.

19. The latching apparatus in accordance with claim 18, wherein a perimeter of the ring gear is in engagement with an additional drive means.

20. The latching apparatus in accordance with claim 19, wherein the perimeter of the ring gear has gear teeth in engagement with a gearwheel of a servomotor.

21. The latching apparatus in accordance with claim 1, wherein the rotor is supported in the housing by means of first rolling bearings.

22. The latching apparatus in accordance with claim 1, wherein the bearing rollers have a running surface that is concave in cross-section, and the bearing race has a running surface that has a complementary convex cross-section.

23. The latching apparatus in accordance with claim 1, wherein the bearing rollers have a running surface that is convex in cross-section, and the bearing race has a running surface that has a complementary concave cross-section.

24. The latching apparatus in accordance with claim 1, wherein the removable part comprises a separation chamber and the bearing assembly is part of a centrifuge.

25. The latching apparatus in accordance with claim 24, wherein the removable part further comprises a discharge line fixedly attached to the separation chamber, and the separation chamber and discharge line form a unitary disposable part.

* * * * *